US006682142B1

(12) United States Patent
Tseng

(10) Patent No.: US 6,682,142 B1
(45) Date of Patent: Jan. 27, 2004

(54) GLIDING CHAIR UNIT WITH LEFT AND RIGHT SAFETY SHIELDS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/447,771

(22) Filed: May 29, 2003

(51) Int. Cl.[7] ..... A47C 15/00
(52) U.S. Cl. ..... 297/246; 297/344.11; 297/463.2
(58) Field of Search ..... 297/246, 261.1, 297/344.1, 344.11, 463.1, 463.2; 248/429, 430

(56) References Cited

U.S. PATENT DOCUMENTS 742,932 A * 11/1903 Tuttle ..... 297/261.3
1,956,772 A * 5/1934 Morton ..... 297/246
2,627,895 A * 2/1953 Lussier ..... 297/246
3,350,134 A * 10/1967 Kotler ..... 297/246
5,123,701 A * 6/1992 Bottamiller et al. ..... 297/261.1
5,188,329 A * 2/1993 Takahara ..... 248/430
5,228,659 A * 7/1993 Potes et al. ..... 248/429
5,285,993 A * 2/1994 Kamata et al. ..... 248/429
5,482,243 A * 1/1996 Minder ..... 248/345.1

* cited by examiner

*Primary Examiner*—Peter R. Crown
(74) *Attorney, Agent, or Firm*—Ladas & Parry

(57) ABSTRACT

A gliding chair unit includes an upper frame that is slidable relative to a base frame between a right position, in which the upper and base frames cooperatively define a left gap, and a left position, in which the upper and base frames cooperatively define a right gap. Left and right safety shields are fixed to and extend outwardly from the upper frame in opposite directions such that when the upper frame is positioned at the right position, the left safety shield covers the left gap, and such that when the upper frame is positioned at the left position, the right safety shield covers the right gap.

2 Claims, 6 Drawing Sheets

GLIDING CHAIR UNIT WITH LEFT AND RIGHT SAFETY SHIELDS

BACKGROUND OF THE INVENTION

1. Field of the Invention

The present invention relates to a gliding chair unit, more particularly to a gliding chair unit with left and right safety shields.

2. Description of the Related Art

Referring to FIG. 1, a conventional gliding chair unit generally includes a base frame 11, an upper frame 12, and left and right seat members 14.

As illustrated, the base frame 11 includes opposite left and right rods 111 that extend in a longitudinal direction, and opposite front and rear rods 112 that extend in a transverse direction relative to the longitudinal direction and that interconnect the left and right rods 111.

The upper frame 12 is mounted slidably on the base frame 11, and includes front and rear rods 122 that are respectively disposed on the front and rear rods 112 of the base frame 11, and left and right rods 121 that extend in the longitudinal direction, that interconnect the front and rear rods 122 of the upper frame 12, and that are respectively disposed adjacent to the left and right rods 111 of the base frame 11.

The left and right seat members 14 are disposed adjacent to the left and right rods 121 of the upper frame 12, respectively, and are secured on the upper frame 12 to span the front and rear rods 122 of the upper frame 12.

The upper frame 12 is slidable on the base frame 11 between a right position, in which the left rod 121 of the upper frame 12 is spaced apart from the left rod 111 of the base frame 11 in the transverse direction to define a left gap (15) therebetween, and a left position, in which the right rod 121 of the upper frame 12 is spaced apart from the right rod 111 of the base frame 11 in the transverse direction to define a right gap therebetween (not shown).

Since the left and right gaps defined by the base and upper frames 11,12 of the conventional gliding chair unit are alternately exposed during gliding of the upper frame 12 relative to the base frame 11, a person nearby may accidentally steps into the exposed gap and get hurt.

SUMMARY OF THE INVENTION

Therefore, the object of this invention is to provide a gliding chair unit having left and right safety shields so as to overcome the aforesaid disadvantage of the prior art.

According to the present invention, a gliding chair unit includes: a base frame including opposite left and right rods that extend in a longitudinal direction, and opposite front and rear rods that extend in a transverse direction relative to the longitudinal direction and that interconnect the left and right rods; an upper frame mounted slidably on the base frame, and including front and rear rods that are respectively disposed on the front and rear rods of the base frame, and left and right rods that extend in the longitudinal direction, that interconnect the front and rear rods of the upper frame, and that are respectively disposed adjacent to the left and right rods of the base frame, the upper frame being slidable on the base frame between a right position, in which the left rod of the upper frame is spaced apart from the left rod of the base frame in the transverse direction to define a left gap therebetween, and a left position, in which the right rod of the upper frame is spaced apart from the right rod of the base frame in the transverse direction to define a right gap therebetween; left and right seat members disposed securely on said upper frame adjacent to the left and right rods, respectively; and left and right safety shields fixed to and extending outwardly in the transverse direction from the left and right rods of the upper frame, respectively, such that when the upper frame is positioned at the right position, the left safety shield covers the left gap, and such that when the upper frame is positioned at the left position, the right safety shield covers the right gap.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
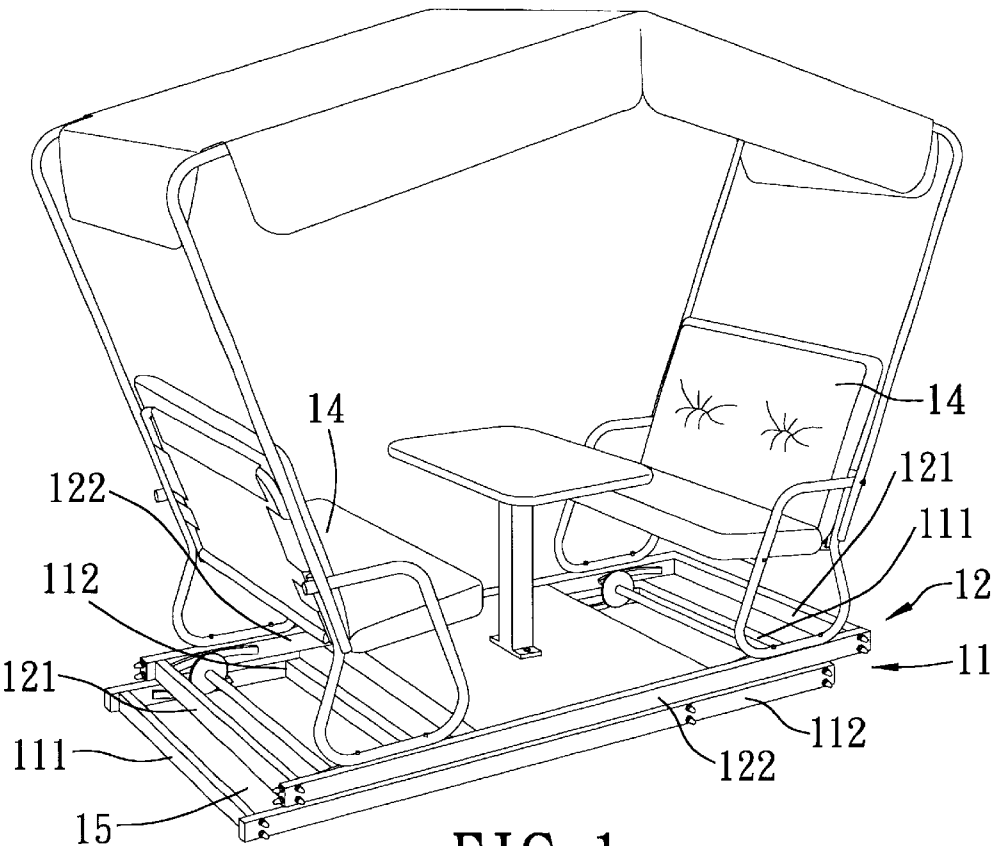
FIG. 1 PRIOR ART
FIG. 1 is a perspective view of a conventional gliding chair unit.
Figure 2:
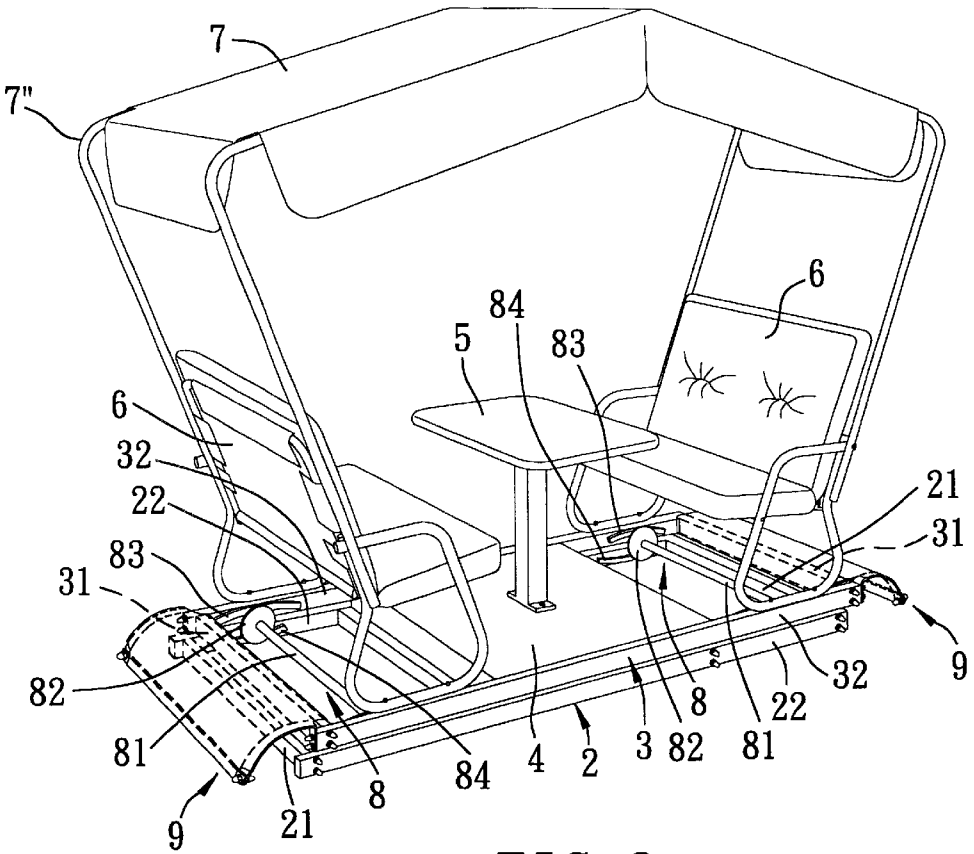
FIG. 2 is a perspective view of the preferred embodiment of a gliding chair unit according to the Present invention.

Referring to FIG. 2, the preferred embodiment of a gliding chair unit according to the present invention is shown to include a base frame 2, an upper frame 3, left and right seat members 6, left and right safety shields 9, a table 5, and a canopy 7.

As illustrated, the base frame 2 includes opposite left and right rods 21 that extend in a longitudinal direction, and opposite front and rear rods 22 that extend in a transverse direction relative to the longitudinal direction and that interconnect the left and right rods 21.

Figure 3:
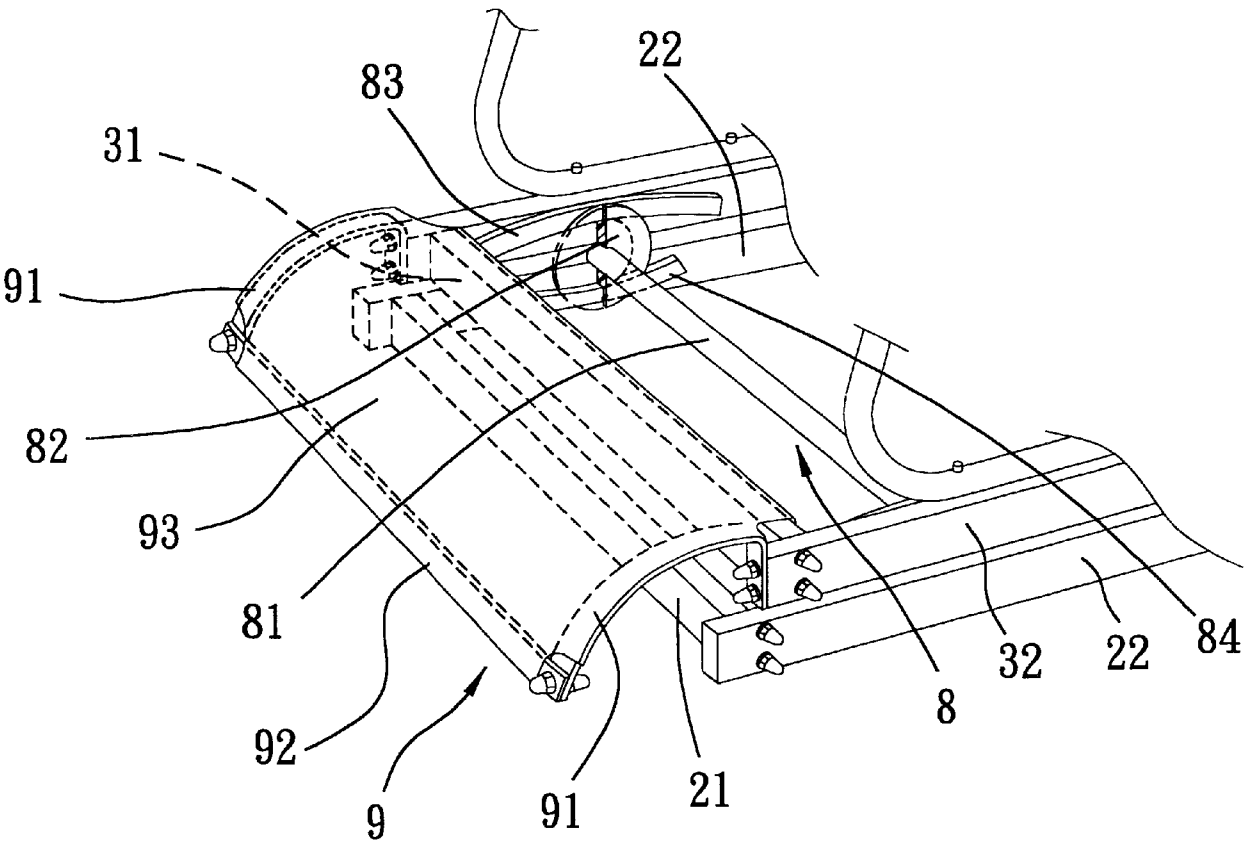
FIG. 3 is a fragmentary perspective view of the preferred embodiment.

The upper frame 3 is mounted slidably on the base frame 2, and includes front and rear rods 32 that are respectively disposed on the front and rear rods 22 of the base frame 2, and left and right rods 31 that extend in the longitudinal direction, that interconnect the front and rear rods 32 of the upper frame 3, and that are respectively disposed adjacent to the left and right rods 21 of the base frame 2. The upper frame 3 is slidable on the base frame 2 between a right position (see FIGS. 3 and 5), in which the left rod 31 of the upper frame 3 is spaced apart from the left rod 21 of the base frame 2 in the transverse direction to define a left gap (G1) therebetween, and a left position (see FIG. 6), in which the right rod 31 of the upper frame 3 is spaced apart from the right rod 21 of the base frame 2 in the transverse direction to define a right gap (G2) therebetween.

The left and right seat members 6 are disposed securely on the upper frame 3 to span the front and rear rods 32 of the upper frame 3 and are adjacent to the left and right rods 31, respectively.

The table 5 is mounted on the upper frame 3 through a mounting board 4 that is fixed to the front and rear rods 32 of the upper frame 3 such that the table 5 is disposed between the left and right seat members 6.

The canopy 7 is mounted on a support member 7" which has legs fixed on the left and right seat members 6.

Figure 4:
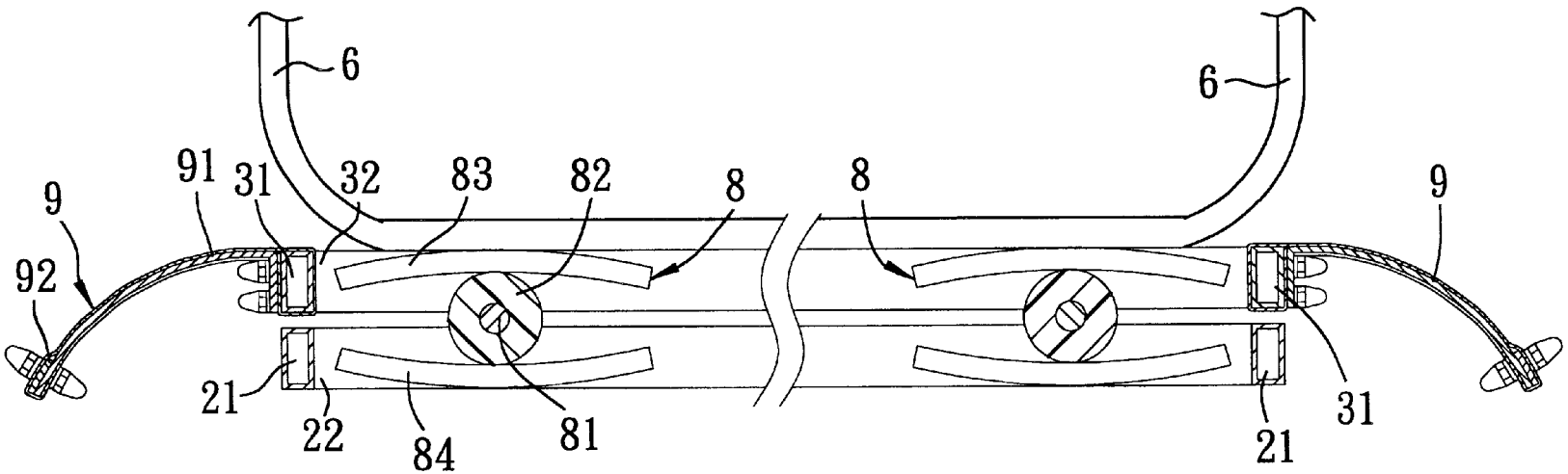
FIG. 4 is a fragmentary, partly sectional view of the preferred embodiment.
Figure 5:
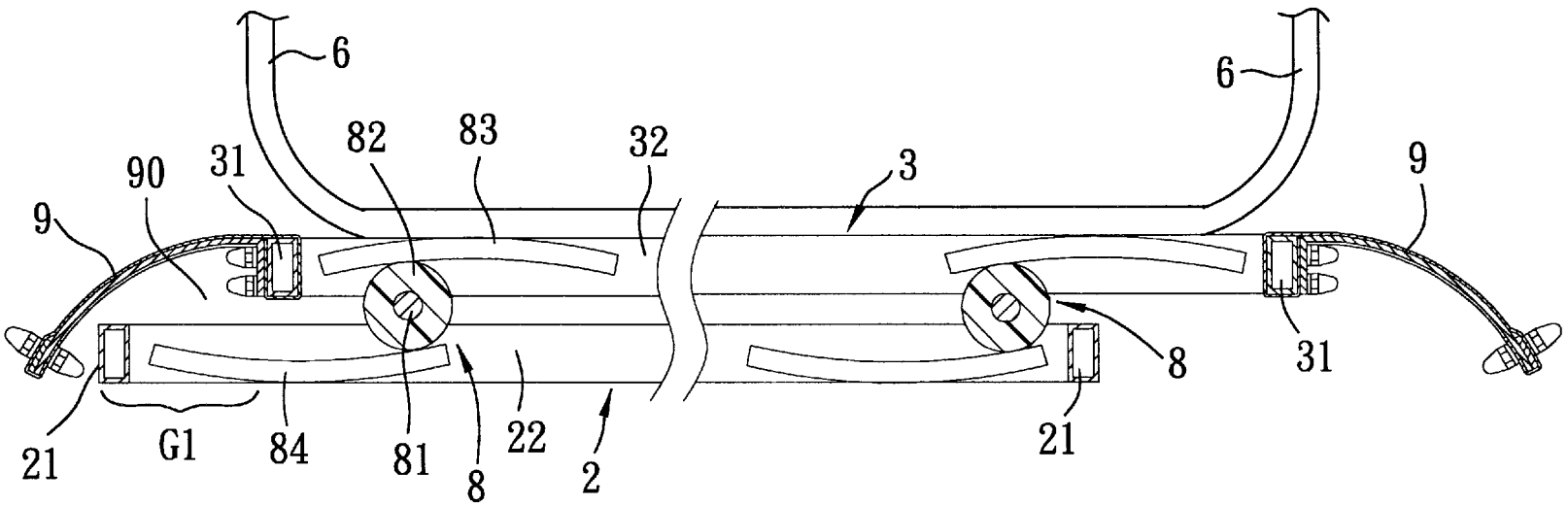
FIG. 5 is a fragmentary, partly sectional view of the preferred embodiment when an upper frame is at the right position relative to a base frame.
Figure 6:
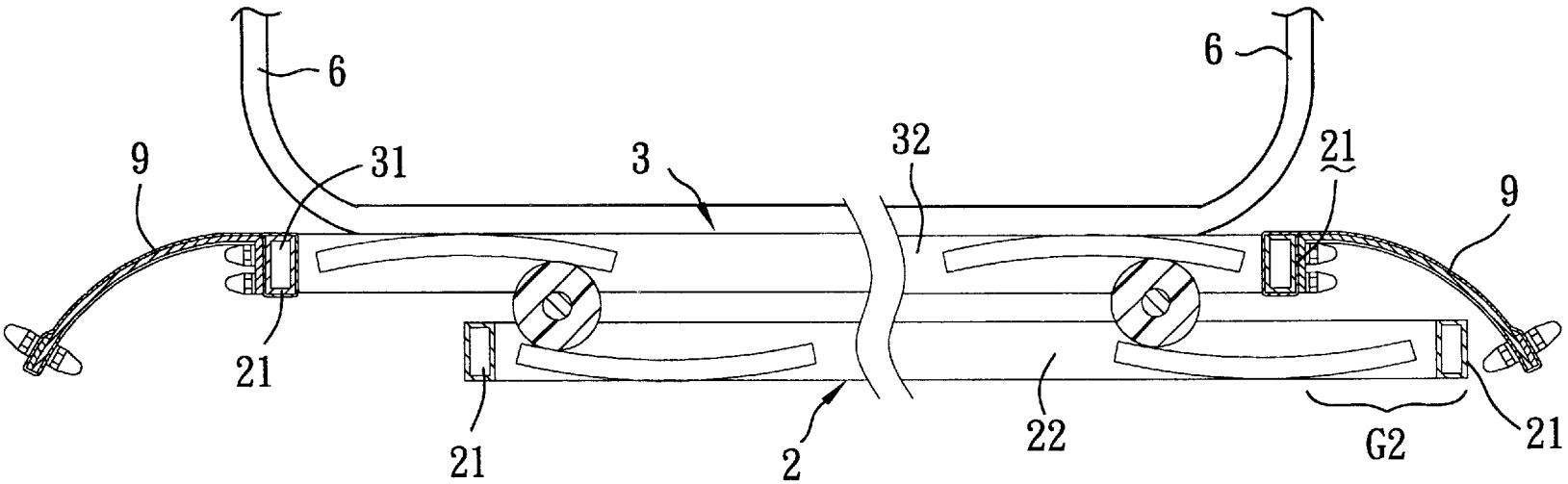
FIG. 6 is a fragmentary, partly sectional view of the preferred embodiment when the upper frame is positioned at a left position relative to the base frame.

Referring to FIG. 4, the left and right safety shields 9 are fixed to the left and right rods 31 of the upper frame 3, respectively, and extend outwardly and respectively from the left and right rods 31 of the upper frame 3 in such a manner that when the upper frame 3 is positioned at the right position, the left safety shield 9 covers the left gap (G1), as best shown in FIG. 5, and that when the upper frame 3 is positioned at the left position, the right safety shield 9 covers the right gap (G2), as best shown in FIG. 6. Each of the left and right safety shields 9 includes a curved frame 91 fixed to a respective one of the left and right rods 31 of the upper frame 3, and a protective sheet 92 mounted on the curved frame 91.

The preferred embodiment further includes a gliding mechanism 8 that is disposed between the base frame 2 and the upper frame 3 to permit gliding movement of the upper frame 3 between the right and left positions, and that includes left and right rail units, and left and right wheel units. The left and right rail units are disposed respectively adjacent to the left rods 21,31 of the base and upper frames 2,3 and the right rods 21,31 of the base and upper frames 2,3. The left and right wheel units slidably and respectively engage the left and right rail units. Each of the left and right rail units includes a pair of curved front rails 83 that are respectively formed on the front rods 22,32 of the base and upper frames 2,3 and that define a front wheel-receiving space therebetween, and a pair of curved rear rails 84 that are respectively formed on the rear rods 22, 32 of the base and upper frames 2,3 and that define a rear wheel-receiving space therebetween, which is aligned with the front wheel-receiving space. Each of the left and right wheel units includes a connecting rod 81 that extends in the longitudinal direction and that has two opposite ends, and a pair of front and rear wheels 82 that are respectively mounted on the opposite ends of the connecting rod 81 and that are respectively received in the front and rear wheel-receiving spaces in a respective one of the left and right rail units so as to permit gliding movement of the upper frame 3 relative to the base frame 2.

In the present invention, since the left and right safety shields 9 alternately cover the right and left gaps (G1,G2) during gliding of the upper frame 3 relative to the base frame 2, the aforesaid disadvantage of the prior art can be overcome.

With this invention thus explained, it is apparent that numerous modifications and variations can be made without departing from the scope and spirit of this invention. It is therefore intended that the invention be limited only as indicated in the appended claims.

I claim:

1. A gliding chair unit comprising:

a base frame including opposite left and right rods that extend in a longitudinal direction, and opposite front and rear rods that extend in a transverse direction relative to said longitudinal direction and that interconnect said left and right rods;

an upper frame mounted slidably on said base frame, and including front and rear rods that are respectively disposed on said front and rear rods of said base frame, and left and right rods that extend in said longitudinal direction, that interconnect said front and rear rods of said upper frame, and that are respectively disposed adjacent to said left and right rods of said base frame, said upper frame being slidable on said base frame between a right position, in which said left rod of said upper frame is spaced apart from said left rod of said base frame in said transverse direction to define a left gap therebetween, and a left position, in which said right rod of said upper frame is spaced apart from said right rod of said base frame in said transverse direction to define a right gap therebetween;

left and right seat members disposed securely on said upper frame adjacent to said left and right rods, respectively; and left and right safety shields fixed to and extending outwardly in said transverse direction from said left and right rods of said upper frame, respectively, such that when said upper frame is positioned at said right position, said left safety shield covers said left gap, and such that when said upper frame is positioned at said left position, said right safety shield covers said right gap.

2. The gliding chair unit as defined in claim 1, further comprising a gliding mechanism coupled to said base frame and said upper frame to permit gliding movement of said upper frame between said left and right positions, said gliding mechanism including left and right rail units disposed respectively adjacent to said left rods of said base and upper frames and said right rods of said base and upper frames, and left and right wheel units slidably and respectively engaging said left and right rail units, each of said left and right rail units including a pair of curved front rails that are respectively formed on said front rods of said base and upper frames and that define a front wheel-receiving space therebetween, and a pair of curved rear rails that are respectively formed on said rear rods of said base and upper frames and that define a rear wheel-receiving space therebetween which is aligned with said first wheel-receiving space, each of said left and right wheel units including a connecting rod that extends in said longitudinal direction and that has two opposite ends, and a pair of front and rear wheels that are respectively mounted on said opposite ends of said connecting rod and that are respectively received in said front and rear wheel-receiving spaces in a respective one of said left and right rail units.

* * * * *